US005535705A

United States Patent [19]

Eguchi et al.

[11] Patent Number: 5,535,705

[45] Date of Patent: Jul. 16, 1996

[54] VARIABLE VALVE TIMING SYSTEM HAVING ROTATIONAL VIBRATION DAMPER

[75] Inventors: Katsuhiko Eguchi; Atsushi Sato; Kenji Fujiwaki, all of Kariya, Japan

[73] Assignee: Aisin Seiki Kabushiki Kaisha, Kariya, Japan

[21] Appl. No.: 409,992

[22] Filed: Mar. 24, 1995

[30] Foreign Application Priority Data

Mar. 25, 1994 [JP] Japan ..... 6-056363

[51] Int. Cl.[6] ..... F01L 1/34

[52] U.S. Cl. ..... 123/90.17; 74/568 R; 464/2; 123/90.31

[58] Field of Search ..... 123/90.15, 90.17, 123/90.31; 464/1, 2, 160; 251/48, 54, 55, 58; 74/568 R

[56] References Cited

U.S. PATENT DOCUMENTS

| | | | |
|---|---|---|---|
| 5,067,450 | 11/1991 | Kano et al. | 123/90.17 |
| 5,080,052 | 1/1992 | Hotta et al. | 123/90.17 |
| 5,090,365 | 2/1992 | Hotta et al. | 123/90.17 |
| 5,215,046 | 6/1993 | Takenaka et al. | 123/90.17 |
| 5,341,777 | 8/1994 | Miura et al. | 123/90.17 |
| 5,377,639 | 1/1995 | Nakadouzono et al. | 123/90.17 |

FOREIGN PATENT DOCUMENTS

| | | | |
|---|---|---|---|
| 4-134108 | 5/1992 | Japan | 123/90.17 |
| 6-10625 | 1/1994 | Japan . | |
| 6-185316 | 7/1994 | Japan | 123/90.17 |

*Primary Examiner*—Weilun Lo
*Attorney, Agent, or Firm*—Burns, Doane, Swecker & Mathis

[57] ABSTRACT

A variable valve timing system includes helical splines to effect a relative rotation between an input member and an output member. The output member drives an intake and an exhaust valve against the urging force of a valve spring. The valve spring gives an undesired torque to the output member. The helical splines have backlash and the undesired torque causes a hitting noise. Therefore, a guide depression filled with viscous fluid is formed in front of the input member and a projection located and moved in the depression is formed in front of the output member. The depression and the projection with the viscous fluid form a damper to absorb the undesired torque.

4 Claims, 3 Drawing Sheets

VARIABLE VALVE TIMING SYSTEM HAVING ROTATIONAL VIBRATION DAMPER

FIELD OF THE INVENTION

The present invention relates to a valve timing system, and more particularly pertains to a variable valve timing system having rotational vibration damping.

BACKGROUND OF THE INVENTION

A conventional variable valve timing system is disclosed in Japanese Patent Publication Laid-Open Publication No. 6(1994)-10625. With reference to FIG. 4, this conventional system includes a timing pulley 101 which is driven by a crank pulley 102 of an engine 103 via a belt 104. A cup-shaped cover 111 is fixed to the pulley 101 and an open portion of the cover 111 is closed by the pulley 101 to form an inner space 112 therein. An inner cylindrical surface 101*a* of the pulley 101 is rotatably supported on a cam shaft 121. Several cams 124 (only one cam is shown in FIG. 4) are fixed on the shaft 121 and each of them drives an intake valve 125 (or an exhaust valve) against the force of a valve spring 126.

The conventional system also includes a cup-shaped case 113 that is fixed to one end of the cam shaft 121 and divides the inner space 112 into a damper space 122 and an oil pressure space 123. A cylindrical piston 114 is located between the pulley 101 and the case 113 to transmit the rotational torque of the pulley 101 to the cam shaft 121. Helical connections such as a helical spline are individually formed between the pulley 101 and the piston 114 and between the piston 114 and the case 113.

When the piston 114 is moved in the axial direction in response to pressure in the oil pressure area 123, the cam shaft 121 rotates relative to the pulley 101 according to the action of the helical connections. As a result, the angular position of the cam shaft 121 advances with respect to the angular position of the pulley 101.

The cup-shaped cover 111 is fixed to the timing pulley 101 and rotates relative to the cup-shaped case 113. A cylindrical gap 131 is formed between the inner cylindrical surface of the cover 111 and the outer cylindrical surface of the case 113 in the damper region 122. A portion 132 is formed at the left end of the cylindrical gap 131 in the damper region 122 and is in fluid communication with the cylindrical gap 131. Viscous fluid is enclosed in the damper space 122 and the gap 131 is also filled with the viscous fluid.

When the engine 103 is in operation, the cam shaft 121 rotates in a uniform direction (in a positive direction). However, torque arising from the urging force of the valve spring 126 imparts an undesirable positive and negative rotation to the cam shaft 121. The undesirable rotation is transmitted to the case 113, and the case 113 rotates relative to the cover 111, the piston 114 and the pulley 101. Therefore, hitting or impact noises occur in the helical connections because the helical splines of the helical connections have backlash.

To prevent such noise, viscous fluid in the cylindrical gap 131 is designed to retard relative rotation. That is, the viscosity of the viscous fluid resists the relative rotation between the case 113 and the cover 111. However, the viscous fluid in the cylindrical gap 131 flows out to the portion 132 since fluid pressure in the gap 131 is higher than that in the portion 132. As a result, the amount of viscous fluid in the gap 131 is lessened and the retarding action thereof is reduced.

Damper mechanisms such as those described in U.S. Pat. No. 5,067,450 (issued on Nov. 26, 1991) and U.S. Pat. No. 5,090,365 (issued on Feb. 25, 1992) have a more powerful damper action which may overcome the aforementioned drawbacks. That is because each of them has a labyrinth mechanism between the timing pulley and the cup-shaped case. However, such a mechanism is complicated in structure and is relatively high in cost.

SUMMARY OF THE INVENTION

It is an object of the present invention to provide an improved damper mechanism for a variable valve timing system which addresses the above-described disadvantages and drawbacks. In accordance with one aspect of the present invention, a variable valve timing system includes an input member which generates rotational torque, an output member receiving the rotational torque from the input member to drive a valve, and a piston for transmitting the torque from the input member to the output member to cause the output member to rotate relative to the input member when the piston is moved in an axial direction. A damper cover is fixed to the input member and has a guide depression elongated in a circumferential direction of the damper cover which is filled with viscous fluid. Also, a damper case is fixed to the output member to form a damper space. The damper case has a projection located and movable in the guide depression of the damper cover, with the projection being disposed at an end of the damper case.

In accordance with another aspect of the present invention, a variable valve timing system is comprised of an input member which generates a rotational torque, an output member receiving the rotational torque to operate a valve, an axially movable piston for transmitting the rotational torque from the input member to the output member to effect rotation of the output member relative to the input member when the piston is moved axially, and a viscous damper located between the input member and the output member for retarding relative rotation between the input member and the output member by a change of volume of the damper.

Another aspect of the invention involves a variable valve timing system having a timing pulley which generates a rotational torque, a cam shaft which receives the rotational torque to operate a valve, a piston which transmits rotational torque from the timing pulley to the cam shaft and which makes the cam shaft rotate relative to the timing pulley when the piston is moved in the axial direction, and a damper cover fixed to the timing pulley. The damper cover has a guide depression which is elongated in a circumferential direction of the damper cover and which is filled with viscous fluid. A damper case is fixed to the cam shaft to form a damper space with the damper cover. The damper case has a projection located in and movable along the guide depression of the damper cover, with the projection extending from an end of the damper case. Additionally, a gap acting as an orifice is formed between the outer surface of the projection and the inner surface of the guide depression.

BRIEF DESCRIPTION OF THE DRAWING FIGURES

A more complete appreciation of the invention and many of the attendant advantages thereof will be readily appreciated and more fully understood by reference to the following detailed description when considered in connection with the accompanying drawing figures in which like elements bear like numerals and wherein.

DETAILED DESCRIPTION OF THE PREFERRED EMBODIMENTS

Figure 1:
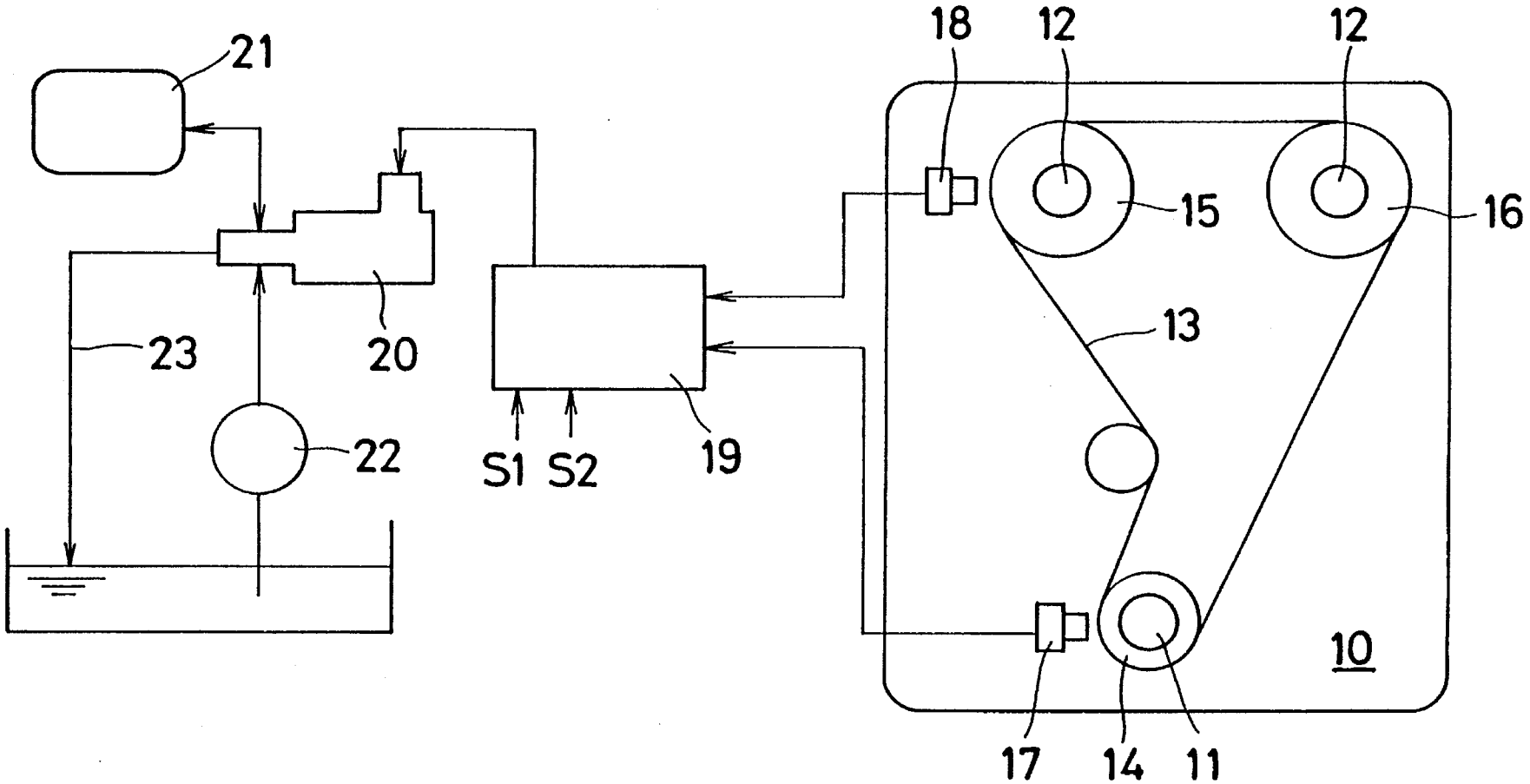
FIG. 1 is a schematic illustration of a variable valve timing system according to an embodiment of the invention.
Figure 2:
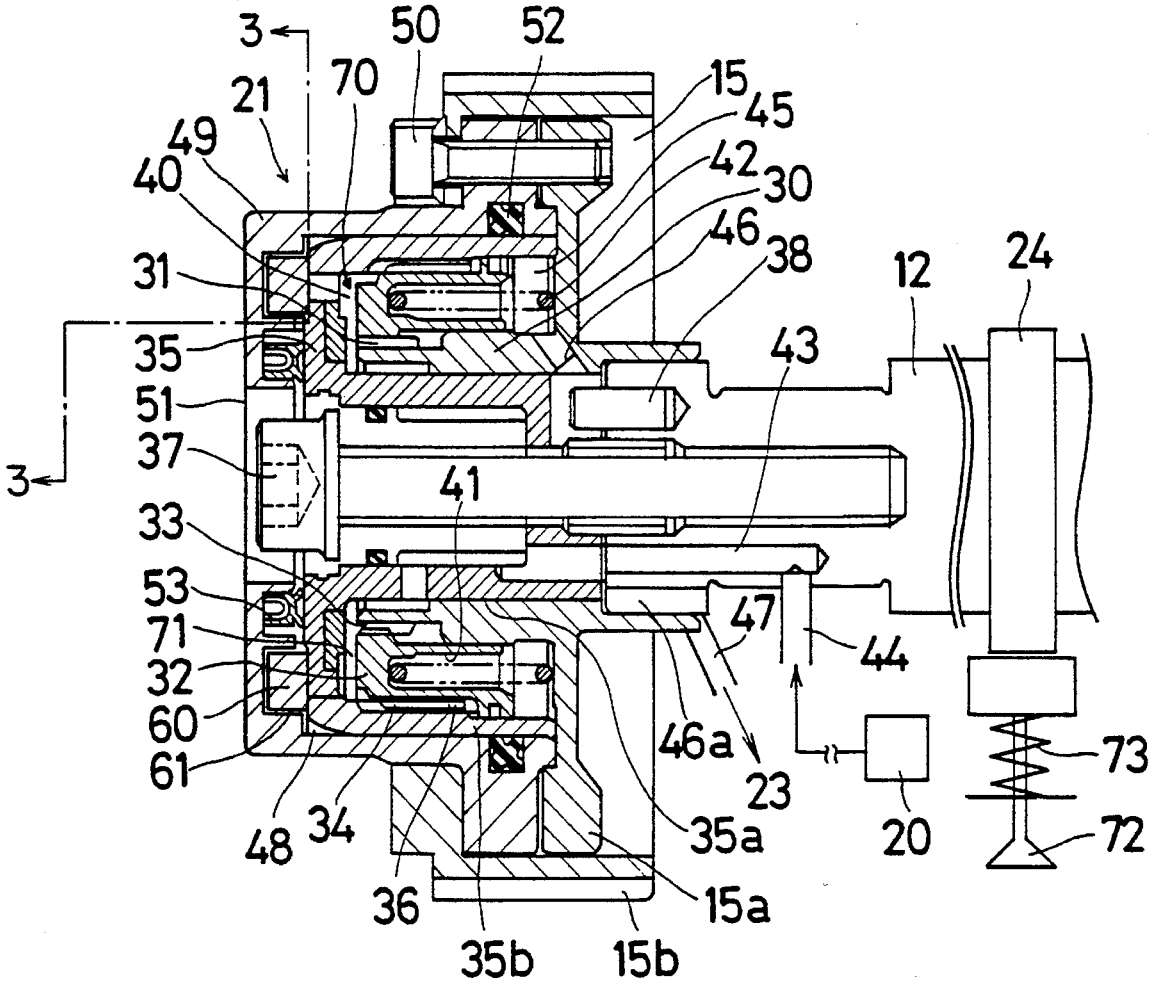
FIG. 2 is a partial cross-sectional view of the variable valve timing system shown in FIG. 1.

With reference initially to FIG. 1 in which a variable valve timing system is shown, an engine 10 comprises a crank shaft 11 outputting a driving torque and cam shafts 12, 12 (output members) for driving intake valves (only one intake valve is shown in FIG. 2) and exhaust valves (not shown). A crank pulley 14 is fixed to the crank shaft 11 and timing pulleys (input members) 15, 16 are fixed to the cam shafts 12, 12. The driving torque of the crank shaft 11 is transmitted to the timing pulleys 15, 16 via a timing belt 13 so that rotational torque is imparted to the pulleys 15, 16. The angular position of the crank shaft 11 is measured or determined by a sensor 17 and the angular position of one of the cam shafts 12 is measured or determined by a sensor 18. Although not specifically shown in FIG. 1, the angular position of each of the cam shafts 12, 12 may be measured or determined by respective sensors. The output signals of both sensors 17, 18 are input into a central processing unit 19. Further, a signal S1 indicative of the opening ratio of a throttle valve (not shown), a signal S2 indicative of the coolant temperature of the engine 10 and so on are also input into the central processing unit 19. The central processing unit 19 outputs control signal to a control valve 20 in response to input signals inputted to the unit 19.

The control valve 20 supplies oil pressure from an oil pump 22 to an apparatus 21 when the apparatus 21 makes the angular position of the cam shaft 12 advance over the angular position of the pulley 15. The control valve 20 also discharges oil pressure from the apparatus 21 to a drain 23 when the apparatus 21 makes the angular position of the cam shaft 12 adjust over the angular position of the pulley 15.

The apparatus 21 is shown in FIG. 2 and as can be seen a plurality of cams 24 (only one cam is shown in FIG. 2) are located on the cam shaft 12. The apparatus 21 is located on one end of the cam shaft 12. Each of the cams 24 drives an intake valve 72 (or an exhaust valve) against the force of a valve spring 73.

A cup-shaped case 35 is fixed to the one end of the cam shaft 12 by a bolt 37 and a pin 38. The timing pulley 15 comprises a main body **15*a*, a gear 15*b* and a cup-shaped cover 49 that are integrated with one another by a bolt 50. The main body 15*a* of the pulley 15 is rotationally supported on a surface 35*a* of the case 35 and rotates relative to the cam shaft 12. A cylindrical piston 32 is located in a space 70 where a flange portion 30 of the main body 15*a* is opposed to a flange portion 35*b* of the case 35. The cylindrical portion 32** is movable in an axial direction.

The piston 32 comprises a first inner helical spline 33 and a first outer helical spline 34. The first inner helical spline 33 is geared with a third outer helical spline 31 formed on the flange portion 30 of the main body **15*a*. The first outer helical spline 34 is geared with a fourth inner helical spline 36 formed on the flange portion 35*b* of the case 35. Thus, the rotational torque of the pulley 15 is transmitted to the cam shaft 12 via the piston 32 and the case 35. The helical splines 31, 33, 34, 36 transform the movement of the piston 32 axially to a relative rotation between the main body 15*a* of the pulley 15 and the case 35. A spring 42 is located between the main body 15*a* of the pulley 15 and the piston 32 to urge the piston 32 leftwardly. An oil pressure room or space 40 is formed at the left end of the piston 32 in the space 70. The oil pressure space 40 is in fluid communication with the control valve 20 via passages 43, 44. The passage 43 is formed in the cam shaft 12 and the case 35 while the passage 44 is formed in a body (not shown) of the engine 10**.

A drain room or space 45 is formed at the right end of the piston 32 in the space 70. The drain room 45 is in fluid communication with the drain 23 via passages **46, 46*a*, 47. The passage 46 is formed in the main body 15*a* of the pulley 15, the passage 46*a* is formed in the cam shaft 12, and the passage 47 is formed in the body (not shown) of the engine 10**.

Figure 3:
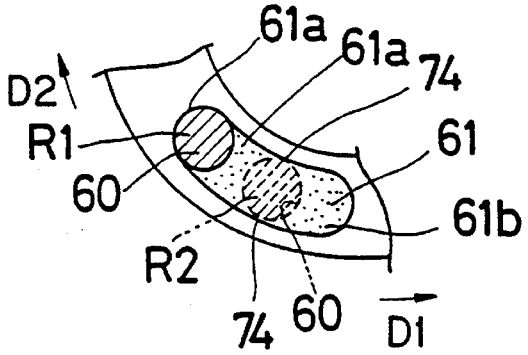
FIG. 3 is a cross-sectional view along the section line 3—3 in FIG. 2.
Figure 4:
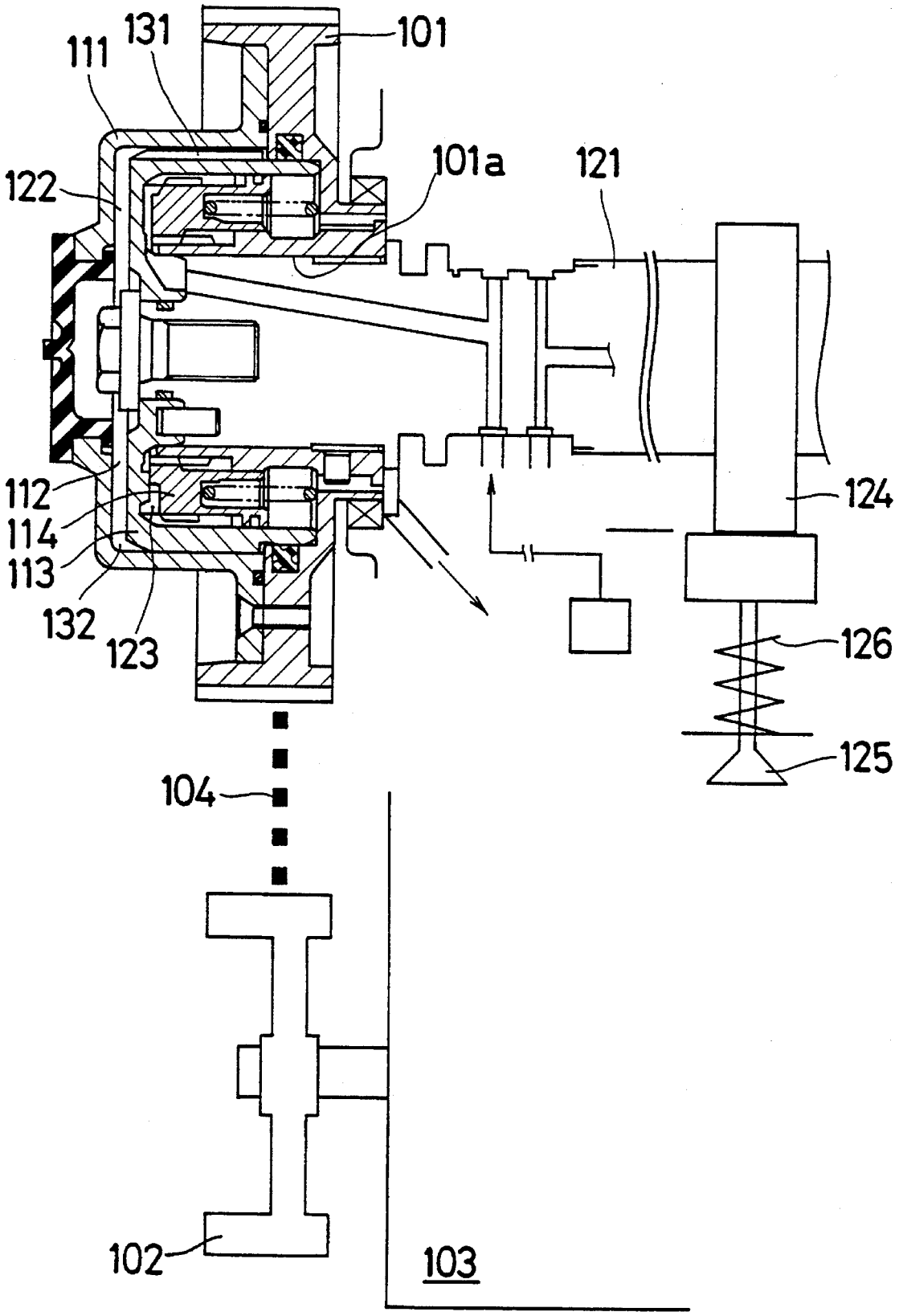
Fig. 4 (Prior Art)
FIG. 4 is a partial cross-sectional view similar to FIG. 2, but shows a conventional variable valve timing system.

A gap (damper space) 48 which encloses viscous fluid is formed axially and inwardly between an outer surface of the case 35 and an inner surface of the cover 49. A right end portion of the gap 48 is sealed by an X-shaped seal ring 52 and an inner end portion of the gap 48 is sealed by a seal ring 53. Referring to FIG. 3, several projections 60 (two projections are shown in FIG. 2) are formed on the left (front) end of the case 35. The projections 60 can be integrally or separately formed with the case 35. Guide depressions 61 are formed on the cover 49 and are elongated in the circumferential direction. Each of the projections 60 is located in each of the depressions 61 and its movement is limited in the depressions 61. The depressions 61 are filled with the viscous fluid enclosed in the gap 48. A gap 74 between an outer surface of the projections 60 and an inner surface of the depressions 61 is small, and the gap 74 acts as an orifice.

The operating action of the variable valve timing system is as follows:

When the operation of the engine 10 is started, the cam shafts 12, 12 are driven by the crank shaft 11 by way of the belt 13. The cams on the shafts 12 open and close the intake and exhaust valves periodically. The angular position of the cam shaft 12 governs the opening timing of each of the intake and exhaust valves. However, the angular position of the cam shaft 12 is uniformly adjusted with the angular position P3 of the timing pulley 15 (the angular position of the crank shaft 11). The engine is driven under operation from a low to high speed revolution region. The opening timing is suitably timed according to the revolution region of the engine. The variable valve timing system of the invention may change the opening timing according to the revolution region under which the engine is operating.

The output signal of the sensor 17 is inputted into the central processing unit 19 so that the unit 19 is apprised of the revolution region under which the engine 10 is operating. When the engine 10 runs in the idle speed region or the high speed revolution region, the unit 19 drives the valve 20 and discharges the oil pressure from the oil pressure space 40 of the apparatus 21 to a drain 23. At this time, oil pressure discharged from the oil pump 22 is not supplied to the apparatus 21. Therefore, only the urging force of the spring 42 influences the piston 32 and consequently the piston 32 is located at the left end in the space 70. However, a gap 71 is formed between the left end of the piston 32 and the right end of the case 35 because the rotation of the case 35 connected with the piston 32 is limited by the contact between the projections 60 and the end 61*a* of the depressions 61. As shown in FIG. 3, the depressions 61 limit the movement of the projections 60. The angular position of the cam shaft 12 is the same as or aligned with the angular position of the timing pulley 15 (the angular position of the crank shaft 11 ). The projections 60 are located at R1 in the depressions 61 as shown in FIG. 3.

When the engine 10 begins to run on a low or a middle speed revolution region, the unit 19 drives the valve 20 to supply oil pressure from the oil pump 22 to the oil pressure area 40 of the apparatus 21. Therefore, oil pressure is introduced into the space 40 via the passages 44, 43 and influences the piston 32. The piston 32 moves rightwardly against the urging force of the spring 42 and is located at the right end of the space 70. The angular position of the cam shaft 12 advances with respect to the angular position of the timing pulley 15 (the angular position of the crank shaft 11). The projections 60 are now located at R2 in the depressions 61 as seen in FIG. 3. Oil in the oil pressure room 40 leaks into the drain room 45 and is discharged to the drain 23 via passages 46, 46*a*, 47.

While the piston 32 moves rightwardly, the case 35 rotates relative to the cover 49 in a direction D1. The relative rotational speed of the case 35 and the cover 49 is not high enough to cause a damper action of the projections 60 and the depressions 61. The damper action is described later. Thus, the projections 60 and the depressions 61 do not influence the relative rotation of the case 35 and the cover 49.

Again, when the engine 10 begins to run on the idle or the high speed revolution region, the unit 19 drives the valve 20 to discharge oil pressure from the oil pressure room 40 of the apparatus 21 to a drain 23. The piston 32 moves leftwardly according to the urging force of the spring 42 and is located at the left end of the space 70.

While the piston 32 moves leftwardly, the case 35 rotates relative to the cover 49 in a direction D2. The direction D2 is the reverse of the direction D1. The reverse relative rotational speed of the case 35 and the cover 49 is also not high enough to cause the damper action of the projections 60 and the depressions 61 to arise. Thus, the projections 60 and the depressions 61 do not influence the relative rotation of the case 35 and the cover 49. Since the gap 71 exists, the piston 32 does not hit the cover 35 and there is no hitting noise therebetween. In other words, the front (left) end of the piston 32 does not contact the case 35.

The cam shaft 12 rotates in a uniform direction (in a positive direction). However, regardless of the speed revolution region under which the engine 10 is operating, torque occurring by the urging force of the valve spring 73 imparts undesired positive and negative rotation to the cam shaft 12. The undesired rotation is transmitted to the case 35 and the case 35 rotates relative to the cover 49, the piston 32 and the main body 15*a* due to the backlash associated with the helical splines 31, 33, 34, 36. The relative rotational speeds at this time are high enough to cause the damper action of the projections 60 and the depressions 61 to take affect. That is, viscous fluid in the portion 61*a* flows into the portion 61*b* via the gap 74, for example. Viscous resistance occurs when the viscous fluid flows through the gap 74 acting as an orifice and the volume of the portion 61*a* is changed (reduced). The damper action retards the relative rotational speed and prevents a hitting noise from occurring in the helical splines 31, 33, 34, 36. When the torque occurring by the valve spring 73 is large, the cam shaft 12 unnecessarily advances or retards with respect to the timing pulley 15. However, the damper action also prevents this from occurring.

It is noted that the guide depressions 61 may be formed on the case 35 and the projections 60 may be formed on the cover 49. Further, the central processing unit 19 considers or takes into account the opening ratio of the throttle valve, the coolant temperature of the engine 10 and so on when the unit 19 drives the apparatus 21.

The principles, preferred embodiments and modes of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A variable valve timing system comprising:

an input member for generating a rotational torque;

an output member for receiving the rotational torque generated by the input member to operate a valve;

an axially movable piston for transmitting rotational torque from the input member to the output member to effect rotation of the output member relative to the input member when the piston is moved axially;

a damper cover fixed to the input member;

a damper case fixed to the output member;

a guide depression which is formed on one of the damper cover and the damper case so as to extend in a circumferential direction, said guide depression being filled with viscous fluid;

a projection extending from the other of the damper cover and the damper case, said projection being located in the guide depression to divide the guide depression into two space portions, the projection being movable along the guide depression; and a small gap formed between an outer surface of the projection and an inner surface of the guide depression which acts as an orifice through which viscous fluid in one of the space portions flows into the other of the space portions while generating large flow resistance of viscous fluid when the damper case is rotated relative to the damper cover.

2. A variable valve timing system as recited in claim 1, wherein the guide depression limits movement of the projection so that a front end of the piston remains spaced from and out of contact with the damper case.

3. A variable valve timing system as recited in claim 2, wherein the output member comprises a cam shaft, and the input member comprises a timing pulley rotatably mounted on the cam shaft.

4. A variable valve timing system as recited in claim 3, including inner and outer helical gears formed on the piston, an inner helical gear formed on the damper case and an outer helical gear formed on the timing pulley, said inner helical gear of the damper case meshing with the outer helical gear of the piston, and the outer helical gear of the timing pulley meshing with the inner helical gear of the piston.

* * * * *